United States Patent [19]

Takahashi et al.

[11] Patent Number: 4,762,769

[45] Date of Patent: Aug. 9, 1988

[54] SILVER HALIDE PHOTOGRAPHIC MATERIAL

[75] Inventors: Toshiro Takahashi; Ken-ichi Kuwabara; Masahiro Okada, all of Kanagawa, Japan

[73] Assignee: Fuji Photo Film Co., Ltd., Kanagawa, Japan

[21] Appl. No.: 909,670

[22] Filed: Sep. 22, 1986

[30] Foreign Application Priority Data

Sep. 20, 1985 [JP] Japan ..... 60-206258

[51] Int. Cl.[4] ..... G03C 1/36

[52] U.S. Cl. ..... 430/264; 430/949; 430/606; 430/267

[58] Field of Search ..... 430/591, 592, 594, 580, 430/606, 599, 600, 603, 264, 949, 564, 267, 510, 522

[56] References Cited

U.S. PATENT DOCUMENTS

| | | | |
|---|---|---|---|
| 2,274,782 | 3/1942 | Gaspar | 430/510 |
| 2,956,879 | 10/1960 | Van Campen | 430/503 |
| 3,718,472 | 2/1973 | Oliver et al. | 430/522 |
| 4,452,882 | 6/1984 | Akimura et al. | 430/949 |
| 4,681,836 | 7/1987 | Inoue et al. | 430/264 |

FOREIGN PATENT DOCUMENTS 0138200 4/1985 European Pat. Off. .

OTHER PUBLICATIONS

Patent Abstracts of Japan, vol. 9, No. 58 (P-341) (1781), Mar. 1985, "Image-Forming Method", to Haniyu; JPA 59-192447, Published: Mar. 8, 1986.

Patent Abstracts of Japan, vol. 10, No. 206 (P-478) (2292), Jul. 1986, "Photosensitive Silver Halide Material for Daylight Room", to Mihara; JPA 61-47949, Published: Nov. 2, 1984.

*Primary Examiner*—Won H. Louie

*Attorney, Agent, or Firm*—Sughrue, Mion, Zinn, Macpeak and Seas

[57] ABSTRACT

A silver halide photographic material which has at least one silver halide emulsion layer comprising silver chloride or silver chlorobromide grains which has a bromide content of 5 mol % or less, and containing a rhodium salt in an amount of from $1\times10^{-6}$ to $5\times10^{-4}$ mole per mole of silver in said layer, and contains both a hydrazine derivative and a dye having an absorption peak in the wavelength region of from 400 nm to 550 nm in at least one of said emulsion layer another hydrophilic colloid layer, to thereby control the ratio of sensitivity at 360 nm to sensitivity at 400 nm ($S_{360}/S_{400}$ ratio) to not less than 30, thereby achieving ultra-high contrast, high sensitivity, and a satisfactory aptitude for safelight.

9 Claims, No Drawings

SILVER HALIDE PHOTOGRAPHIC MATERIAL

FIELD OF THE INVENTION

The present invention relates to a silver halide photographic material, and, more particularly, to a silver halide photographic material which can be handled under conditions that can substantially be called bright conditions.

BACKGROUND OF THE INVENTION

The photographic plate-making process for reproduction in the graphic arts includes steps of converting a photographic image having continuous gradation into a so-called dot image which represents light and shade of image by the size of dot areas, and combining the resulting dot image with characters and line original, thereby making a printing master.

In order to reproduce photographic line and dot images in a desirable condition, it is required that photographic materials for the photographic plate-making process have high contrast and high photographic density in order to have image areas distinguished clearly from nonimage areas, that is to say, to bear a so-called ultra-high contrasty photographic characteristic (particularly to have gamma of 10 or above).

In response to the expressed desire in this art to carry out a contact exposure step (a so-called contact work) under bright conditions using a light-sensitive material of relatively low photographic speed, photographic light-sensitive materials capable of being handled under conditions that can substantially be called bright conditions notwithstanding that silver halide is employed as the light-sensitive substance therein have been developed. The above-described desire can be fulfilled by employing a light-sensitive material which contains silver halide grains formed in the presence of an inorganic desensitizer such as a rhodium salt, an iridium salts, cupric chloride or so on, or a silver halide emulsion to which an organic desensitizer such as pinakryptol yellow, phenosafranine, or so on is added, whereby the sensitivity of the silver halide emulsion is extremely lowered (to less than conventional ones by a factor of from $10^4$ to $10^5$) so that the material may not have any substantial sensitivities to visible rays of wavelengths not shorter than 400 nm, and exposing the light-sensitive material by means of a printer equipped with a powerful light source which can emit ultraviolet rays in large quantities (e.g., an ultra-high pressure mercury lamp, a metal halide lamp, etc.). However, such a light source suffers from disadvantages that it consumes electricity in great quantity (e.g., 1 to 2 KW), and the price thereof is very high. Therefore, it has been desired to develop light-sensitive materials which enable the use of a more economical light source of an energy saving type.

On the other hand, for the purpose of achieving ultra-high contrasty characteristics, (particularly gamma of 10 or above) in the photographic printing plate-making process, it has been conventional to employ a method in which a so-called lithotype silver halide photographic material comprising silver chlorobromide the halide composition of which is 40 mol % or less bromide and the remainder chloride, is treated with a hydroquinone developer (a lith developer) in which the effective concentration of sulfite ion is very low (generally 0.1 mol/-liter or less). However, the developer used in such a method is extremely unstable to air oxidation because of a low sulfite ion concentration therein.

Therefore, it has been required to overcome the instability in image formation according to such lithographic development, and further to provide an image-forming system which can ensure ultra-high contrasty photographic characteristics not withstanding development using a processing solution excellent in keeping stability. Under these circumstances, systems for forming ultra-high contrasty negative images having gamma of 10 or above, which consist in processing surface latent image type silver halide photographic material, in which particular acylhydrazine derivatives were incorporated, with a developer adjusted to a pH of from 10.5 to 12.3 and containing a sulfite preservative in a concentration of 0.15 mol/liter or more, thereby achieving excellent keeping stability, have been described in U.S. Pat. Nos. 4,166,742, 4,168,977, 4,221,857, 4,224,401, 4,243,739, 4,272,606, 4,311,781, and so on.

In such stable systems for image formation, ultra-high contrasty gradation is obtained by taking advantage of the electron injection reaction of hydrazine derivatives into silver halides. Accordingly, if a large amount of desensitizer were to be incorporated into silver halide grains and/or an emulsion layer of such a system, it would be expected that the contrast would be decreased.

Moreover, addition of a safelight dye to an emulsion layer for the purpose of lowering sensitivity to visible rays has been found to cause the loss of capabilities in controlling line width of characters and tone of dot images in the contact work, (which signify more specifically the abilities to make the width of the line image somewhat broader than that of characters of an original, and to enlarge dot areas of halftone image to some extent, compared with those of an original). In the contact work, not only is the ability to reproduce exactly the same line with and dot area as those of an original required, but also the capability of introducing modifications into an original with the intention of adding artistic expression to line and halftone images is required. Furthermore, the addition of a safelight dye has turned out in some cases to check the above-described contrast-increasing effect of hydrazine derivatives.

SUMMARY OF THE INVENTION

Therefore, an object of the present invention is to provide a silver halide photographic material which can be handled under bright safelight (bright room) without spoiling a contrast-increasing effect due to a hydrazine derivative incorporated therein, and that has sensitivity higher than conventional photographic material's for bright room and can exhibit ultra-high contrasty photographic characteristics by processing with a stable developer.

The above-described object is attained with a silver halide photographic material which has at least one silver halide emulsion layer comprising silver chloride grains or silver chlorobromide grains which have a bromide content of 5 mol % or less, and containing a rhodium salt in an amount of from $1\times10^{-6}$ to $5\times10^{-4}$ mole per mole of silver, and contains both a hydrazine derivative and a dye having an absorption peak within the wavelength range of from 400 nm to 550 nm in at least one of the silver halide emulsion layer and another hydrophilic colloid layer, to thereby control the ratio of sensitivity at 360 nm to sensitivity at 400 nm ($S_{360}/S_{400}$ ratio) to not less than 30/1.

DETAILED DESCRIPTION OF THE INVENTION

In order to enhance the handling facility under bright room by lowering sensitivity of a silver halide emulsion, a water-soluble rhodium salt is employed in the present invention. Typical examples of rhodium salts which can be preferably used include rhodium halide such as rhodium chloride, rhodium trichloride, rhodium ammonium chloride, and the like. Also, complex salts of these chlorides can be used.

The above-described rhodium salts may be added to a silver halide emulsion at any stage of the preparation thereof, provided that the addition is carried out before the completion of the first ripening. In particular, it is desirable to add such salts during formation of silver halide grains so that silver halide grains contain the rhodium salt. The amount of the rhodium salt added generally ranges from $1\times10^{-6}$ to $5\times10^{-4}$ mole per mole of silver, and particularly preferably is from $2\times10^{-6}$ to $5\times10^{-5}$ mole per mole of silver.

Further, it is desirable not to chemically ripen silver halide grains, for the purpose of enhancing the handling facility of the silver halide emulsion under bright room.

The expression "not to chemically ripen silver halide grains" as used herein means that the sensitization step, which has generally been carried out for the purpose of chemical sensitization adding such a sulfur sensitizer as to produce silver sulfide by the reaction with a silver salt, a reduction sensitizer such as stannous salt or amines, and/or a noble metal sensitizer such as chloroaurates, gold trichloride, or the like, or using active gelatin containing sulfur-containing compounds, and maintaining the resulting emulsion at a prescribed temperature and within a prescribed pH range for a prescribed period of time, thereby achieving sensitization, is not conducted in the silver halide emulsion, and a slight extent of sensitization resulting from trace amounts of sensitizing substances contained in innactive gelatin can usually be disregarded as insignificant.

The silver halide employed in the silver halide photographic material of the present invention is silver chloride, or silver chlorobromide having a bromide content of 5 mol % or less, and preferably is silver chlorobromide in which the halide composition is at least 98 mol % silver chloride.

A generally suitable mean grain size of the silver halide is 0.5 μm or less, and preferably the mean grain size is 0.3 μm or less. The term "mean grain size" is used commonly by those skilled in the art of silver halide photography, and it is a readily understandable term. The grain size refers to the grain diameter in case of grains spherical or approximately spherical in shape, while it refers to the edge length multiplied by $\sqrt{4/\pi}$ in the case of cubic grains. In both cases, it is represented by the algebraical or geometrical mean based on the projection areas of the grains. For details of methods for determining a mean grain size reference can be made to C. E. Mees & T. H. James, *The Theory of The Photographic Process,* 3rd. ed., pp. 36–43, Macmillan, New York (1966).

The silver halide grains of the present invention are not particularly limited with respect to crystal form, and may have any forms including tabular, spherical, cubic, octahedral, etc. As for the grain size distribution, a narrow distribution is preferred. Particularly, a so-called monodisperse emulsion wherein 90%, and desirably 95%, of the grains have their individual sizes within the range of ±40% of the mean grain size is preferred over others.

Suitable methods for reacting a water-soluble silver salt with a water-soluble halide include, e.g., a single jet method, a double jet method, and a combination thereof.

Also, a method in which silver halide grains are produced in the presence of excess silver ion (the so-called reverse jet method) can be employed. Further, the so-called controlled double jet method as one of double jet methods, in which the pAg of the liquid phase wherein silver halide grains are to be precipitated is maintained constant, may be employed. According to this method, a silver halide emulsion having a regular crystal form and grain sizes near to uniform can be obtained.

It is desirable to carry out grain formation under an acidic condition. The effect of the present invention has been found to lessen under an alkaline or a neutral condition, a preferable pH range is not higher than 6, and more preferably 5 or less.

Two or more silver halide emulsion layers may be provided, but one layer is generally sufficient. A desirable coverage of the emulsion layer ranges from 1 g/m$^2$ to 8 g/m$^2$ on silver basis.

Preferred examples of hydrazine derivatives which can be used in the present invention include compounds represented by formula (I)

$$R_1\text{—NHNH—G—}R_2 \qquad \text{(I)}$$

wherein $R_1$ represents an aliphatic or aromatic group or unsaturated heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphoryl group, or an N-substituted or unsubstituted iminomethylene group, and include arylhydrazides represented by formula (II), as described in U.S. Pat. No. 4,478,928.

$$\text{Ar—}\overset{\overset{R^{2'}}{|}}{N}\text{—}\underset{\underset{R^{1'}}{|}}{N}\text{—Acyl} \qquad \text{(II)}$$

wherein Acyl is an acyl group, Ar is an aryl group, and $R^{1'}$ is a hydrogen atom or a sulfinic acid radical substituent and $R^{2'}$ is a sulfinic acid radical substituent when $R^{1'}$ is a hydrogen atom, and a hydrogen atom when $R^{1'}$ is a sulfinic acid radical.

In formula (I), suitable aliphatic groups represented by $R_1$ include those containing from 1 to 30 carbon atoms, particularly preferably straight-chain, branched-chain, and cyclic alkyl groups containing from 1 to 20 carbon atoms. Herein, the branched-chain alkyl groups may include those cyclized so as to form a saturated hetero ring containing one or more hetero atoms therein such as a nitrogen atom, an oxygen atom, a sulfur atom, a selenium atom, etc. Further, these alkyl groups may be substituted with an aryl group containing from 6 to 12 carbon atoms, an alkoxy group containing from 1 to 10 carbon atoms, a sulfoxy group containing from 1 to 10 carbon atoms, a sulfonamido group containing from 1 to 10 carbon atoms, a carbonamido group containing from 1 to 10 carbon atoms, and so on.

In formula (I), aromatic groups represented by $R^1$ include monocyclic and dicyclic (conjugated) aryl groups.

The unsaturated heterocyclic groups represented by $R^1$ contain a nitrogen atom, an oxygen atom, a sulfur atom, a selenium atom, etc. as a hetero atom and may be groups formed by fusing together with a monocyclic or dicyclic aryl group.

Preferable examples of these aromatic groups represented by $R^1$ include phenyl, naphthyl, pyridyl, pyrimidinyl, imidazolyl, pyrazolyl, quinolyl, isoquinolyl, benzimidazolyl, thiazolyl, benzothiazolyl, and like groups. Of these groups, those containing a benzene nucleus are more desirable.

A particularly preferred group as $R_1$ is a phenyl group and a naphthyl group.

An aryl group or a unsaturated heterocyclic group represented by $R_1$ may have one or more substituent groups. Typical examples of such a substituent group include straight-chain, branched-chain and cyclic alkyl groups (containing preferably from 1 to 20 carbon atoms), aralkyl groups (an alkyl moiety of which preferably contains from 1 to 3 carbon atoms, and an aryl moiety of which contains one or two rings), an alkoxy groups (containing preferably from 1 to 20 carbon atoms), substituted amino groups (preferably having an alkyl substituent containing from 1 to 20 carbon atoms), acylamino groups (preferably containing from 2 to 30 carbon atoms), sulfonamido groups (preferably containing from 1 to 30 carbon atoms), ureido groups (preferably containing from 1 to 30 carbon atoms), thioureido groups, thioamide groups, arylideneimino groups, heteroarylidene groups, alkylideneimino groups, etc.

In formula (1), alkyl groups represented by $R_2$ are preferably those containing from 1 to 4 carbon atoms, which may be substituted with a halogen atom, a cyano group, a carboxy group, a sulfo group, an alkoxy group containing from 1 to 10 carbon atoms, a phenyl group, etc.

Aryl groups represented by $R_2$ are those containing one or two (condensed) rings, e.g., those containing a benzene ring. These aryl groups may be substituted with a halogen atom, an alkyl group containing from 1 to 10 carbon atoms, a cyano group, a carboxyl group, a sulfo group, etc.

Alkoxy groups represented by $R_2$ are those containing from 1 to 8 carbon atoms, which may be substituted with a halogen atom, an aryl group, etc.

Aryloxy groups represented by $R_2$ are preferably monocyclic. Substituent groups suitable therefor are halogen atoms, etc.

Of groups represented by $R_2$, those preferred over others are hydrogen atom, an alkyl group such as a methyl group etc., an alkoxy group such as a methoxy group, an ethoxy group etc., and a substituted or unsubstituted aryl group such as a substituted or unsubstituted phenyl group etc., in the case where G represents a carbonyl group. In particular, a hydrogen atom is preferred as $R_2$.

In the case where G represents a sulfonyl group, $R_2$ is preferably an alkyl group such as a methyl group, an ethyl group etc.; a phenyl group; or a substituted aryl group such as 4-methylphenyl group etc., and particularly preferably is a methyl group.

In the case where G represents a phosphoryl group, $R_2$ is preferably an alkoxy group such as a methoxy group, an ethoxy group, a butoxy group, etc.; an unsubstituted aryloxy group such as a phenoxy group etc., or an aryl group such as a phenyl group etc., and particularly preferably is a phenoxy group.

In the case wherein G represents a sulfoxy group, preferred $R_2$ is a substituted alkyl group such as a cyanobenzyl group, a methylthiobenzyl group or the like, while when G represents an N-substituted or unsubstituted iminomethylene group, preferred $R_2$ is a methyl group, an ethyl group, or a substituted or unsubstituted phenyl group.

Into $R_1$ or $R_2$ of formula (I) may be introduced a ballast group used commonly in immobile photographic additives like a coupler. A ballast group as used herein signifies a group containing not less than 8 carbon atoms and being relatively inert in respect of its influences on photographic properties, and can be selected from among alkyl groups, containing from 8 to 30 carbon atoms, alkoxy groups containing from 8 to 30 carbon atoms, phenyl group, alkylphenyl groups containing from 8 to 30 carbon atoms, phenoxy group, alkylphenoxy groups containing from 8 to 30 carbon atoms and the like.

Moreover, a group capable of strengthening adsorption on surfaces of silver halide grains may be introduced into $R_1$ or $R_2$ of formula (I). As examples of such adsorptive groups, mention may be made of those described in U.S. Pat. No. 4,385,108, such as thiourea groups, heterocyclic thioamido groups, mercaptoheterocyclyl groups, triazol groups, and so on.

The most preferable group as G of formula (I) is carbonyl group.

Specific examples of compounds represented by formula (I) are illustrated below. However, the present invention should not be construed as being limited to these examples.

I-1

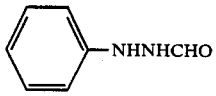

I-2

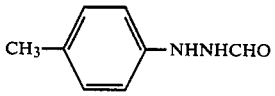

I-3

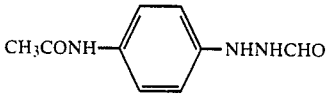

I-4

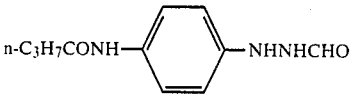

I-5

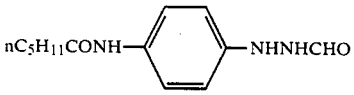

I-6

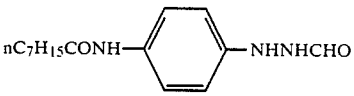

-continued
I-7
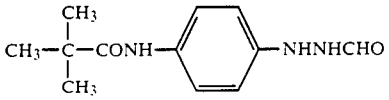
I-8
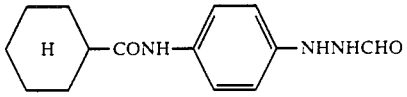
I-9
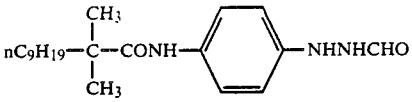
I-10
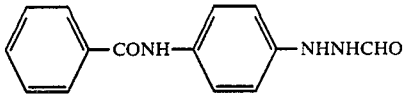
I-11
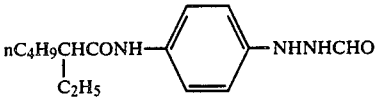
I-12
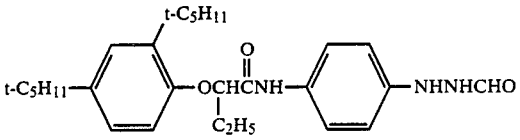
I-13
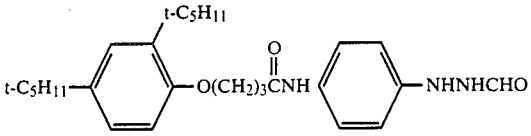
I-14
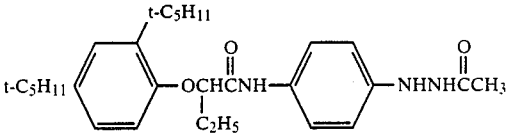
I-15
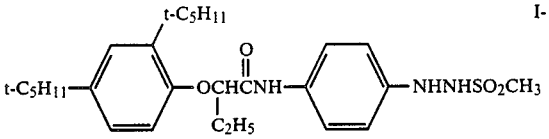
I-16
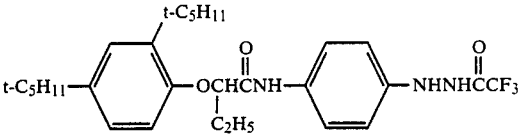
I-17
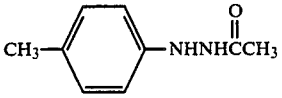
I-18
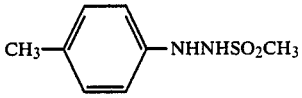
I-19
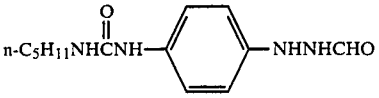
I-20
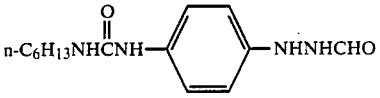
I-21
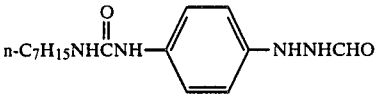
I-22
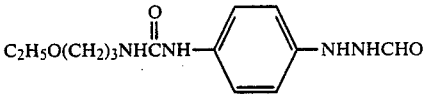
I-23
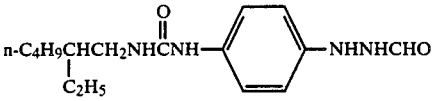
I-24
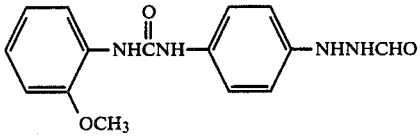
I-25
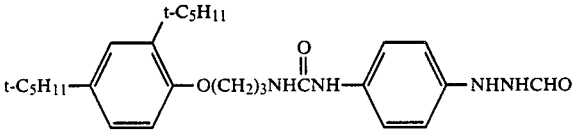
I-26
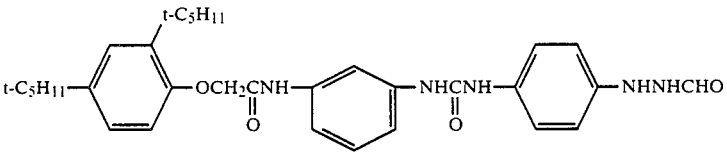

-continued

I-27

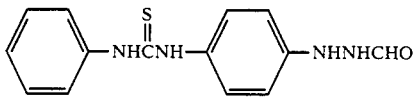

I-28

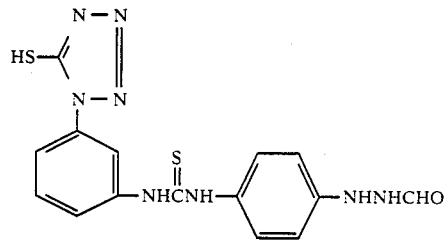

I-29

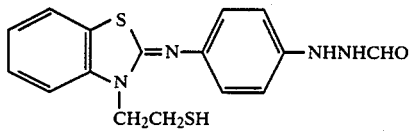

I-30

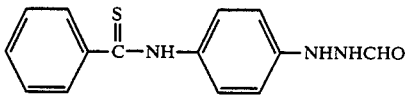

I-31

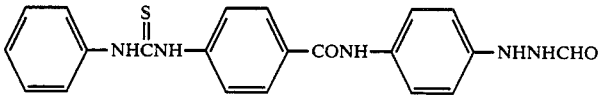

I-32

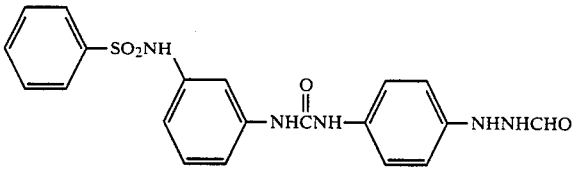

I-33

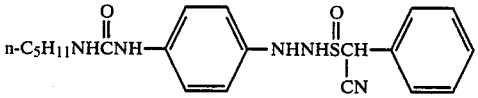

I-34

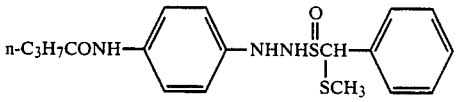

I-35

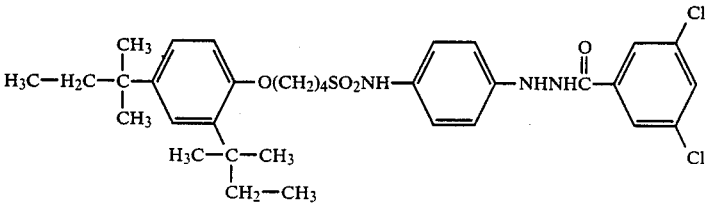

I-36

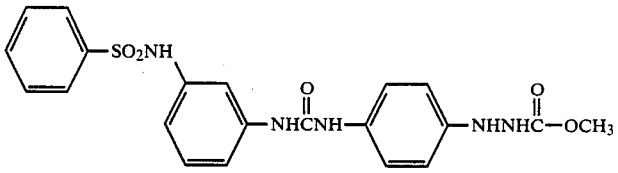

I-37

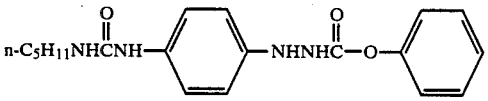

It is generally effective to add a hydrazine derivative employed in the present invention in an amount ranging from $1\times10^{-6}$ to $5\times10^{-2}$ mole, and preferably the hydrazine derivative is employed in an amount ranging from $1\times10^{-5}$ to $2\times10^{-2}$ mole, per mole of silver.

In incorporating a hydrazine derivative which can be employed in the present invention into a photographic light-sensitive material, the hydrazine derivative is added to a silver halide emulsion or a hydrophilic colloidal solution in a condition of aqueous solution when it is soluble in water, while as a solution prepared by dissolving it in a water miscible organic solvent, such as alcohols (e.g., methanol, ethanol, etc.), esters (e.g., ethyl acetate), ketones (e.g., acetone) or the like, when it is insoluble in water.

Hydrazine derivatives which can be employed in the present invention may be added alone, or as a mixture of two or more thereof.

A layer in which the hydrazine derivatives are to be incorporated may be either silver halide emulsion layer or another hydrophilic colloid layer. Also, the hydrazine derivatives may be incorporated in both silver halide emulsion layer and another hydrophilic colloid layer.

Dyes having an absorption peak within the wavelength region of from 400 to 500 nm, which is essential to the present invention, have their main absorption in a visible portion of the wavelength range to which the silver halide emulsion used has intrinsic sensitivity, and are used for the purpose of enhancing the handling facility under bright room conditions. Such dyes do not have any particular limitation with respect to chemical structure. Oxonol dyes, hemioxonol dyes, merocyanine dyes, cyanine dyes, azo dyes, arylidene dyes and so on can be used for the above-described purpose. Of these dyes, water-soluble ones are useful for preventing color stains from remaining after photographic processing.

Specific examples of dyes which can be employed in the present invention include pyrazoloneoxonol dyes described in U.S. Pat. No. 2,274,782, diarylazo dyes as described in U.S. Pat. No. 2,956,879, styryl dyes and butadienyl dyes as described in U.S. Pat. Nos. 3,423,207 and 3,384,487, merocyanine dyes described in U.S. Pat. No. 2,527,583, merocyanine dyes and oxonol dyes as described in U.S. Pat. Nos. 3,486,897, 3,652,284 and 3,718,472, enaminohemioxonol dyes described in U.S. Pat. No. 3,976,661, arylidene dyes described in Japanese Patent Application (OPI) Nos. 3623/76 and 20822/77 (the term "OPI" as used herein means an "unexamined published application" ), bis-type dyes described in Japanese Patent Application Nos. 54883/85, 21306/85, 117456/85, and the specification applied for patent on the 13th of August in 1985 by Fuji Photo Film Co., Ltd. with the title "Silver Halide Photographic Material", and dyes described in British Pat. Nos. 584,609 and 1,177,429, Japanese Patent Application (OPI) Nos. 85130/73, 99620/74, and 114420/74, and U.S. Pat. Nos. 2,533,472, 3,148,187, 3,177,078, 3,247,127, 3,540,887, 3,575,704, and 3,653,905.

Specific examples of dyes which can be used in the present invention are illustrated below. However, the present invention should not be construed as being limited to these compounds.

II-1

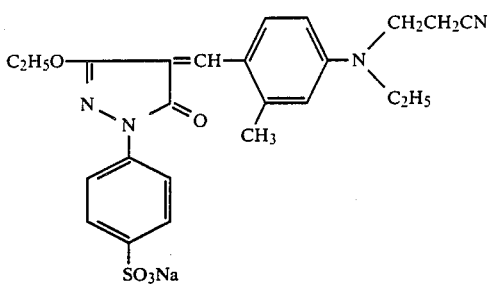

II-2

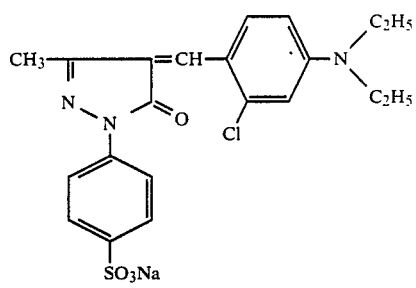

II-3

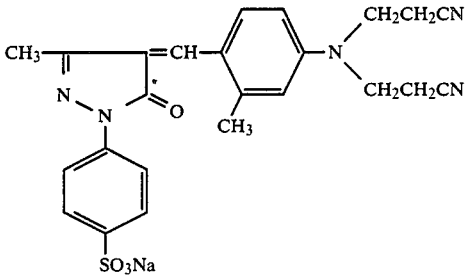

II-4

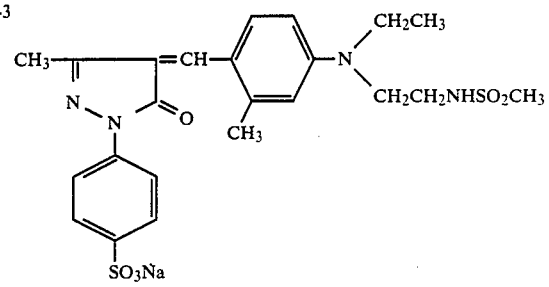

II-5

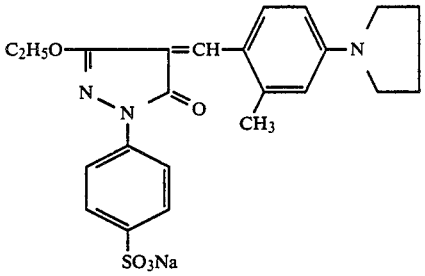

II-6

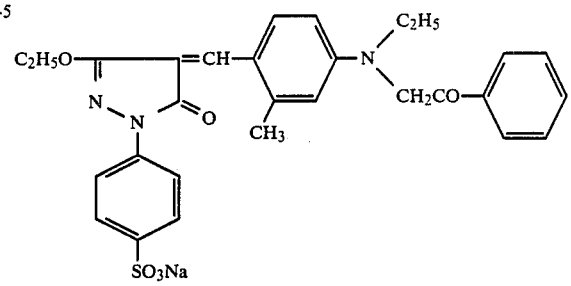

II-7

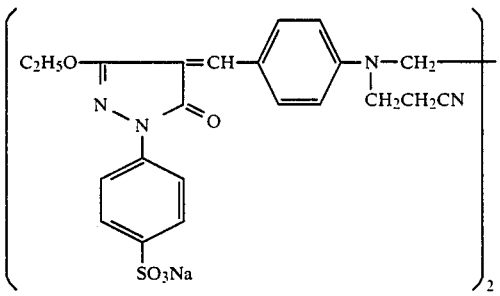

II-8

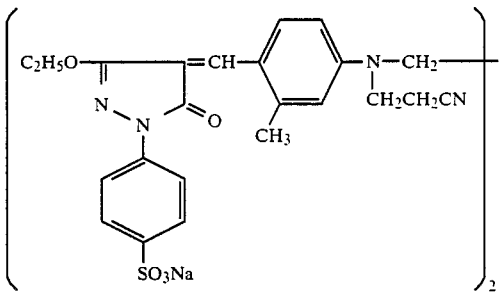

-continued

II-9

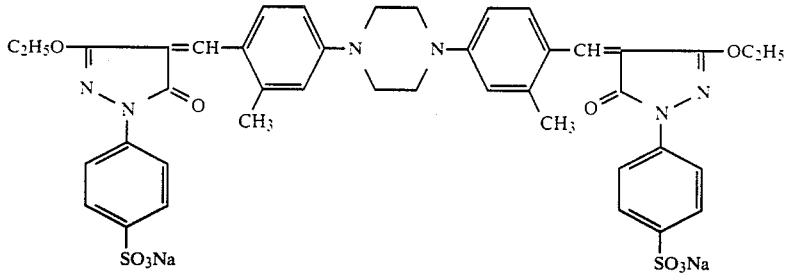

II-10

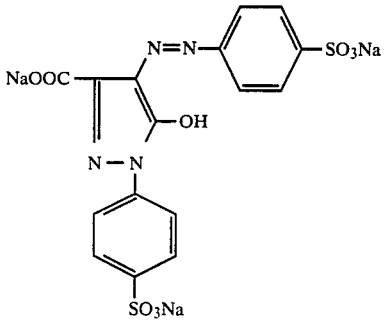

II-11

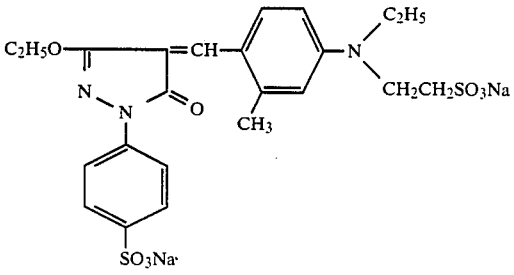

II-12

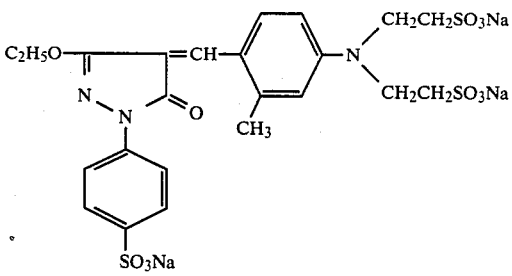

II-13

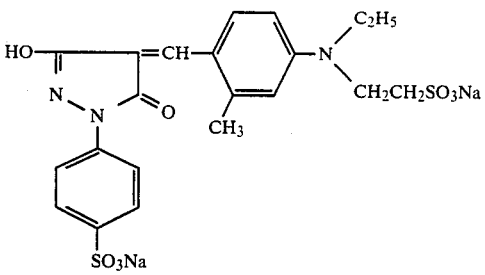

II-14

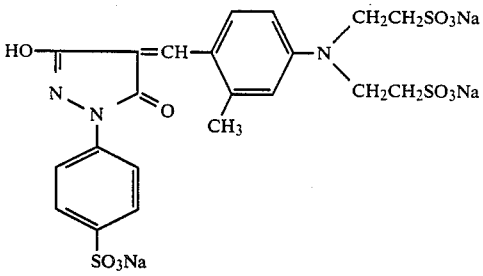

II-15

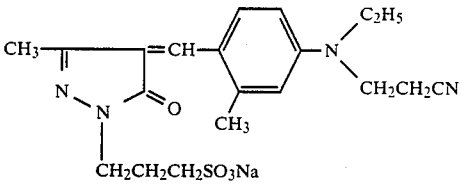

In the present invention, these dyes are used an amount necessary to adjust the $S_{360}/S_{400}$ ratio to 30/1 or more (wherein $S_{360}$ represents the sensitivity at 360 nm, and $S_{400}$ represents the sensitivity at 400 nm), and the amount ranges generally from $10^{-3}$ g/m$^2$ to 1 g/m$^2$, and particularly preferably from $10^{-2}$ g/m$^2$ to 0.5 g/m$^2$.

The $S_{360}/S_{400}$ ratio of a photographic lightsensitive material can be determined from spectral sensitivity measurements carried out using the photographic lightsensitive material exposed with a spectral exposure apparatus, followed by development processing.

In the emulsion layer according to the present invention and other hydrophilic colloid layers, disulfide compounds described in Japanese Patent Application No. 14959/85, phosphonium salt compounds described in Japanese Patent Application No. 9347/85, and hydroquinone derivatives described in Japanese Patent Application No. 80026/85 can also be incorporated.

A suitable content of the disulfide compounds described in Japanese Patent Application No. 14959/85 ranges from $1\times10^{-7}$ to $1\times10^{-2}$ mole, and more preferably from $1\times10^{-6}$ to $5\times10^{-3}$, per mole of silver halide.

A suitable content of the phosphonium salt compounds described in Japanese Patent Application No. 9347/85 ranges from $1\times10^{-6}$ to $1\times10^{-1}$ mole, particularly from $1\times10^{-5}$ to $5\times10^{-2}$ mole, per mole of silver halide.

The hydroquinone derivative described in Japanese Patent Application No. 80026/85 is added in an amount of preferably from $1\times10^{-6}$ to $1\times10^{-1}$, particularly preferably from $1\times10^{-5}$ to $5\times10^{-2}$ mole, per mole of silver halide.

In incorporating a disulfide compound, a phosphonium salt compound and a hydroquinone derivative, as described in Japanese Patent Application Nos. 14959/85, 9347/85 and 80026/85, respectively, into a photographic light-sensitive material, these compounds are added to a silver halide emulsion or a hydrophilic colloid layer in a form of water solution when they are soluble in water, while when insoluble in water they are dissolved in a water miscible organic solvent, such as alcohols (e.g., methanol and ethanol), esters (e.g., ethyl acetate), ketones (e.g., acetaone) or so on, or in a mixture of water and a water miscible organic solvent, and the resulting solution is added to a silver halide emulsion or a hydrophilic colloid solution.

The photographic material of the present invention can contain a wide variety of compounds for purposes of preventing fogging and stabilizing photographic functions during production, storage or photographic processing. More specifically, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and so on; mercaptopyrimidines; mercaptotriazines; thioketo compounds like oxazolinethione; azaindenes such as triazaindenes, tetraazaindenes (especially (1,3,3a,7)tetrazaindenes substituted with a hydroxy group at the 4-position), pentaazaindenes and so on; and other many compounds known as an antifoggant or a stabilizer, such as benzenthiosulfonic acid, benzenesulfinic acids, benzensulfonic acid amides and so on can be added to the photographic material of the present invention.

A hydrophilic colloid layer of the photographic material according to the present invention may additionally contain various kinds of dyes (e.g., ultraviolet absorbing dyes) for the purpose of preventing an irradiation phenomenon, providing an aptitude for safelight, and so on.

Suitable examples of ultraviolet absorbing dyes which can be used include benzotriazole compounds substituted with an aryl group, 4-thiazolidone compounds, benzophenone compounds, cinnamic acid ester compounds, butadiene compounds, benzoxazole compounds, and ultraviolet absorbing polymers.

These dyes may be fixed to a hydrophilic colloid layer provided over the silver halide emulsion layer, as described in Japanese Patent Application No. 14960/85.

The photographic emulsion and light-insensitive hydrophilic colloids which constitute the photographic material of the present invention may contain inorganic or organic hardeners.

Examples of hardeners which can be used include chrome salts (e.g., chrome alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, bis(vinylsulfonyl) methyl ether, N,N'-methylenebis-{$\beta$-(vinylsulfonyl)propioneamide}, etc.), active halogen compounds (e.g., 2,4-dichloro-6-hydroxy-s-triazine, etc.), mucohalogen acids (e.g., mucochloric acid, mucophenoxychloric acid, etc.), isoxazoles, dialdehydostarch, and 2-chloro-6-hydroxytriazinylated gelatin. These hardeners can be used alone or as a combination thereof, and specific examples thereof are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 3,543,292, British Pat. Nos. 676,628, 825,544 and 1,270,578, German Pat. Nos. 872,153 and 1,090,427, Japanese Patent Publication Nos. 7133/59 and 1872/71, and so on.

The light-sensitive emulsion layers and/or light-insensitive hydrophilic colloid layers of the present invention may contain surface active agents for various purposes, such as coating aids, prevention of electrification, improvement of slippability, emulsifying dispersion, prevention of adhesion, and improvements of photographic characteristics.

Gelatin is employed to advantage as a binder or a protective colloid of the photographic emulsions. Hydrophilic colloids other than gelatin can also be used. For instance, other colloids which can be used include proteins such as gelatin derivatives, graftcopolymers of gelatin and other high molecular weight polymers, albumin, casein, etc.; sugar derivatives such as cellulose derivatives (e.g., hydroxyethyl cellulose, carboxymethyl cellulose, cellulose sulfate, etc.), sodium alginate, starch derivatives and the like; and various kinds of synthetic hydrophilic macromolecular substances such as homo- or copolymers including polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and so on.

As for the gelatin, not only lime-processed gelatin, but also acid-processed gelatin may be used. Further, hydrolysis products of gelatin and enzymatic degradation products of gelatin can also be employed.

The photographic emulsions of the present invention can contain dispersions of water insoluble or slightly soluble synthetic polymers for the purpose of improvement in dimensional stability and so on. Suitable examples of such polymers include those containing as constituent monomers an alkyl(metha)acrylate, an alkoxyalkyl(metha)acrylate, a glycidyl(metha)acrylate, a (metha)acrylamide, a vinyl ester (e.g., vinyl acetate), acrylonitrile, an olefin, a styrene and so on individually or in combinations of two or more thereof, or in combination of one or more of the above-described monomer with acrylic acid, methacrylic acid, an $\alpha\beta$-unsaturated dicarboxylic acid, a hydroxyalkyl(metha)acrylate, a sulfoalkyl(metha)acrylate, styrenesulfonic acid, and so on. Specific examples of polymers which can be used for the above-described purpose are described, for example, in U.S. Pat. Nos. 2,376,005, 2,739,137, 2,853,457, 3,062,674, 3,411,911, 3,488,708, 3,525,620, 3,607,290, 3,633,715, and 3,645,740, and British Pat. Nos. 1,186,699 and 1,307,373.

When we intend to obtain ultra-high contrasty photographic characteristic using the silver halide light-sensitive material according to the present invention, it is unnecessary to employ a conventionally used infectious developer or a developer having high alkalinity near to pH 13 as described in U.S. Pat. No. 2,419,975, and a stable developer can be employed.

More specifically, a developer containing as a preservative an abundance of free sulfite ions (particularly 0.15 mol/liter or more) can be used for the above-described silver halide light-sensitive material, and negative images of satisfactorily ultra-high contrast can be obtained using a developer adjusted to a pH of 9.5 or above, and particularly preferably to a pH of 10.5–12.3.

The developing agent to be used in a developer which can be employed for processing the photographic light-sensitive material of the present invention is not particularly restricted. However, it is desirable for the developing agent to include dihydroxybenzenes in that excellent halftone quality is thereby easily obtained. In some cases, combinations of dihydroxybenzenes and 1-phenyl-3-pyrazolidones, or combinations of dihydroxybenzenes and p-aminophenols can be employed as developing agents.

Developing agents of dihydroxybenzene type to be used in the above-described processing include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and the like. Of these hydroquinone type compounds, hydroquinone is especially useful.

Developing agents of 1-phenyl-3-pyrazolidone type which can be used in the above-described processing include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3pyrazolidone, 1-p-aminophenyl-4,4-dimethyl-3-pyrazolidone, 1-phenyl-p-tolyl-4,4-dimethyl-3-pyrazolidone, and the like.

Developing agents of p-aminophenol type which can be used in the above-described processing include N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, and the like. Of these compounds, N-methyl-p-aminophenol is especially useful.

In general, a developing agent is used in an amount ranging generally from 0.005 mol/liter to 0.8 mol/liter. When combinations of dihydroxybenzenes with 1-phenyl-3pyrazolidones or p-aminophenols are employed, it is effective to use the former in an amount of from 0.05 mol/liter to from 0.5 mol/liter and the latter in an amount of 0.06 mol/liter or less.

Preservatives of sulfite type to be used in the processing of the photographic light-sensitive material of the present invention include sodium sulfite, potassium sulfite, lithium sulfite, ammonium sulfite, sodium hydrogen sulfite, potassium metabisulfite, an addition product of formaldehyde and sodium bisulfite, and so on. A preferred addition amount of sulfite is 0.4 mol/liter or more, and particularly preferred amount is 0.5 mol/liter or more, and the upper limit thereof is 2.5 mol/liter.

Alkali agents used for pH adjustment include pH controlling agents and buffering agents, such as sodium hydroxide, potassium hydroxide, sodium carbonate, potassium carbonate, sodium tertiary phosphate, potassium tertiary phosphate, and so on.

In addition to the above-described ingredients, additives such as a development inhibitor (e.g., boric acid, borax, sodium bromide, potassium bromide, potassium iodide, etc.), an organic solvent (e.g., ethylene glycol, diethylene glycol, triethylene glycol, dimethyl formamide, methyl cellosolve, hexylene glycol, ethanol, methanol, etc.), and an antifoggant or an agent for preventing black spots like black pepper (e.g., mercapto compounds such as 1-phenyl-5-mercaptotetrazole, sodium 2-mercaptobenzimidazole-5-sulfonate, etc., indazole compounds such as 5-nitroindazole, etc., benzotriazole compounds such as 5-methylbenzotriazole, etc.) may be contained in the developer. Further, the developer may optionally contain a toning agent, a surface active agent, a defoaming agent, a water softener, a hardener, an amino compound as described in Japanese Patent Application (OPI) No. 106244/81, and so on.

EXAMPLE 1

Two kinds of emulsions A and B were prepared in the following manner, using solutions I and II, the compositions of which are described below.

Solution I: Water 300 ml, Gelatin 9 g.

Solution II: $AgNO_3$ 100 g, Water 400 ml.

(1) Preparation of Emulsion A (Rh content: $0.5\times10^{-5}$ mol/per mol silver)

Solution IIIA: NaCl 37 g, $(NH_4)_3RhCl_6$ 1 mg, Water 400 ml.

Solution II and Solution IIIA were simultaneously added at a constant rate to Solution I while maintaining the temperature at 45° C. Soluble salts were removed from the thus prepared emulsion in a conventional manner well-known in the art, and then gelatin and 6-methyl-4-hydroxy-1,3,3a,7-tetraazaindene as a stabilizer were added successively to the emulsion. A mean grain size of this emulsion was 0.20 μm, and a 1 kg portion of the emulsion contained 60 g of gelatin.

(2) Preparation of Emulsion B (Rh content: $1\times10^{-5}$ mol/mol of silver)

Solution IIIB: NaCl 37 g, $(NH_4)_3RhCl_6$ 2 mg, Water 400 ml.

Emulsion B was prepared in the same manner as Emulsion A except that Solution IIIB was used in place of Solution IIIA.

To each of these emulsions, one of the hydrazine derivative and one of the dyes of the present invention were added in their respective amounts as shown in Table 1, and further, a dispersion of polyethylacrylate and sodium salt of 2-hydroxy-4,6-di-chloro-1,3,5-triazine were added. The resulting emulsion was coated on a polyethylene terephthalate film at a coverage of 3.5 $gAg/m^2$.

On the thus formed emulsion layer was coated a gelatin solution as a protective layer at a dry coverage of 1 $g/m^2$.

Each sample thus obtained was exposed through an optical wedge by means of a printer Model P-607 (made by Dainippon Screen Mfg. Co., Ltd.), and then developed with a developer having the composition described below at 38° C. for 20 seconds. Subsequently, the sample was subjected successively to stop, fixation, washing, and drying steps in accordance with the following conditions.

Stopping: 3% Acetic acid solution, 38° C., 5 seconds

Fixation: FUJI GSL System Liq. Fixer GF-1 38° C., 20 seconds

Washing: 38° C., 20 seconds

Drying: 50° C.

In addition, these samples were examined for stability to safelight carrying out the above-described developmentprocessing. The results obtained are shown in Table 1.

| Composition of Developer: | |
|---|---|
| Disodium Ethylenediaminetetraacetate | 1.0 g |
| Sodium Hydroxide | 9.0 g |
| Potassium Tertiary Phosphate | 74.0 g |
| Potassium Sulfite | 90.0 g |
| 3-Diethylamino-1-propanol-N—methyl-p-aminophenol.½ Sulfate | 0.8 g |

-continued

| Composition of Developer: | |
|---|---|
| Hydroquinone | 35.0 g |
| 5-Methylbenzotriazole | 0.5 g |
| Sodium Bromide | 3.0 g |
| Water to make | 1 liter (pH = 11.6) |

The superscript (1) in Table 1 signifies the sensitivity determined as the reciprocal of exposure required for providing a density of 1.5, and is shown as a relative value with Sample 8 being taken as 100.

The superscript (2) in Table 1 means that gamma is defined as (3.0−0.3)/-{log(exposure required for providing a density of 0.3)−log(exposure required for providing density of 3.0)}

The superscript (3) means that superimposed letter image quality was evaluated as follows. As described in Japanese Patent Application (OPI) No. 190943/83, a layout base, a film on which positive line images were formed (line original), and a layout base and a film on which dot images were formed (halftone dot original) were superposed in the order listed, and the halftone dot original and the protective layer of each sample film were brought into face-to-face contact with each other. Correct exposure was given to the resulting superposed matter under such conditions such that the dot area of 50% on the halftone dot original might be reproduced as a dot area of 50% on the sample film, followed by the above-described photographic processing. When characters having line width of 30 μm on the line original could be reproduced on the sample film as a result of the above-described procedures, the superimposed letter image quality was ranked as the highest, and represented by a numerical value 5, while when only characters having line width of 150 μm could be reproduced, it was ranked as the lowest, and represented by a numerical value 1. According to visual sensory evaluation, three other ranks 4, 3 and 2 were provided between the highest rank 5 and the lowest rank 1. If a sample is evaluated as the rank 2, it is barely fit for practical use.

The superscript (4) means that fog due to safelight exposure was determined by exposing a sample under about 200 lux for 15 minutes using an anti-fading fluorescent lamp (FLR 40 SW-Dl-X NU/M, product of Toshiba Corporation) and then subjecting it to development-processing.

TABLE 1

| Sample | Emulsion (Rh: mol/mol silver) | Amount of I-26 added (mol/mol silver) | Dyes added Kind | Dyes added Amount ($g/m^2$) | Relative Sensitivity[1] | $\gamma^2$ | Image Quality on missed Characters[3] | Fog after Exposure to Safelight[4] | $S_{360}/S_{400}$ |
|---|---|---|---|---|---|---|---|---|---|
| 1 | A ($0.5 \times 10^{-5}$) | $4 \times 10^{-4}$ | — | — | 220 | 20 | 5 | 5.00 | 18 |
| 2 | A ($0.5 \times 10^{-5}$) | $4 \times 10^{-4}$ | II-1 | 0.1 | 170 | 24.5 | 5 | 0.02 | 30 |
| 3 | A ($0.5 \times 10^{-5}$) | $4 \times 10^{-4}$ | II-1 | 0.2 | 150 | 19 | 5 | 0.01 | 51 |
| 4 | A ($0.5 \times 10^{-5}$) | $4 \times 10^{-4}$ | II-4 | 0.2 | 150 | 22.5 | 5 | 0.01 | 40 |
| 5 | A ($0.5 \times 10^{-5}$) | $4 \times 10^{-4}$ | II-7 | 0.2 | 110 | 18 | 4 | 0.01 | 50 |
| 6 | A ($0.5 \times 10^{-5}$) | $4 \times 10^{-4}$ | II-10 | 0.1 | 105 | 16 | 4 | 0.01 | 46 |
| 7 | A ($0.5 \times 10^{-5}$) | $4 \times 10^{-4}$ | (a)* | 0.2 | 35 | 6.5 | 1 | 5.00 | 8 |
| 8 | B ($1 \times 10^{-5}$) | $4 \times 10^{-4}$ | — | — | 100 | 18 | 5 | 0.01 | 18 |

(a)*: Comparative Dye having the formula

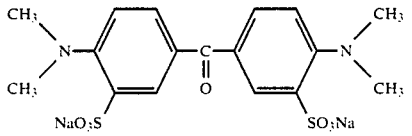

As can be seen from the results in Table 1, Samples 2 to 6 according to the present invention (those having a $S_{360}/S_{400}$ ratio of 30 or more) had high sensitivity and a satisfactory aptitude for safelight. Compared with Sample 8, which did acquire improved aptitude for safelight by containing an increased amount of Rh in the emulsion, the samples of the present invention showed an unexpected superiority in having enhanced sensitivity. In addition, these samples, though containing dyes, acquired very good image quality owing to the contrast-increasing effect of the hydrazine derivative I-26.

While the invention has been described in detail and with reference to specific embodiments thereof, it will be apparent to one skilled in the art that various changes and modification can be made therein without departing from the spirit and scope thereof.

What is claimed is:

1. A silver halide photographic material which has at least one silver halide emulsion layer comprising silver halide grains selected from silver chloride grains and silver chlorobromide grains which have a bromide content of 5 mol % or less, and containing a rhodium salt in an amount of from $1\times10^{-6}$ to $5\times10^{-4}$ mole per mole of silver in said layer, and contains both a hydrazine derivative and a dye having an absorption peak in the wavelength range of from 400 nm to 550 nm in at least one of said emulsion layer and another hydrophilic colloid layer, to thereby control the ratio of sensitivity at 360 nm to sensitivity at 400 nm ($S_{360}/S_{400}$ ratio) to not less than 30/1.

2. A silver halide photographic material as in claim 1, wherein said silver chloride or silver bromochloride grains contains said rhodium salt in an amount of from $2\times10^{-6}$ to $5\times10^{-5}$ mole per mole of silver in said layer.

3. A silver halide photographic material as in claim 1, wherein said silver chlorobromide or silver chloride has a halide composition of at least 98 mol % silver chloride.

4. A silver halide photographic material as in claim 1, wherein said silver halide grains have a mean grain size of 0.5 μm or less.

5. A silver halide photographic material as in claim 1, wherein said hydrazine derivative is present in an amount of from $1\times10^{-6}$ to $5\times10^{-2}$ mole per mole of silver halide.

6. A silver halide photographic material as in claim 1, wherein said dye is present in an amount of from $10^{-3}$ $g/m^2$ to 1 $g/m^2$.

7. A silver halide photographic material as in claim 1, wherein said dye is selected from the group consisting of oxonol dyes, hemioxonol dyes, merocyanine dyes, cyanine dyes, azo dyes and arylidene dyes.

8. A silver halide photographic material as in claim 1, wherein the hydrazine derivative is selected from compounds represented by formula (I) or (II)

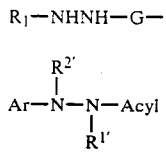

$$R_1-NHNH-G-R_2 \quad (I)$$

$$Ar-\underset{\underset{R^{1'}}{|}}{N}(R^{2'})-N-Acyl \quad (II)$$

wherein $R_1$ represents an aliphatic or aromatic group or unsaturated heterocyclic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfonyl group, a sulfoxy group, a phosphonyl group, or an N-substitued or unsubstituted iminomethylene group; Acryl is an acyl group; Ar is an aryl group, and $R^{1'}$is a hydrogen atom or a sulfinic acid radical substituent and $R^{2'}$is a sulfinic acid radical substituent when $R^{1'}$is a hydrogen atom, and a hydrogen atom when $R^{1'}$is a sulfinic acid radical.

9. A silver halide photographic material as in wherein said hydrazine derivative is present in an amount of $1\times10^{-6}$ to $5\times10^{-2}$ g/m$^2$ to 1 g/m$^2$, wherein said dye is selected from the group consisting of oxonol dyes, hemioxonol dyes, merocyanine dyes, cyanine dyes, azo dyes and arylidene dyes, and wherein the hydrazine derivative is selected from compounds represented by formula (I) or (II)

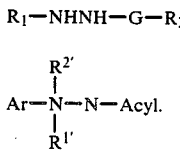

$$R_1-NHNH-G-R_2 \quad (I)$$

$$Ar-\underset{\underset{R^{1'}}{|}}{N}(R^{2'})-N-Acyl. \quad (II)$$

* * * * *